US006306031B1

(12) United States Patent
Hansen et al.

(10) Patent No.: US 6,306,031 B1
(45) Date of Patent: Oct. 23, 2001

(54) FIREHOUSE EXHAUST SYSTEM

(75) Inventors: Harold W. Hansen, Wilsonville; Jerald W. Hansen, Tigard; James N. Hansen, Lake Oswego, all of OR (US)

(73) Assignee: Energy Savings Products, Portland, OR (US)

( * ) Notice: Subject to any disclaimer, the term of this patent is extended or adjusted under 35 U.S.C. 154(b) by 0 days.

(21) Appl. No.: 09/539,354

(22) Filed: Mar. 31, 2000

(51) Int. Cl.[7] ..... F23J 11/04
(52) U.S. Cl. ..... 454/64; 454/63
(58) Field of Search ..... 454/63, 64

(56) References Cited

U.S. PATENT DOCUMENTS

| | | | | |
|---|---|---|---|---|
| D. 338,610 | | 8/1993 | Johansson . | |
| D. 357,303 | | 4/1995 | Karlsson et al. . | |
| 3,941,041 | | 3/1976 | Sprout . | |
| 4,660,465 | | 4/1987 | Jantzsch et al. | 454/64 |
| 4,762,054 | | 8/1988 | Melville et al. . | |
| 5,096,230 | * | 3/1992 | Pausch et al. | 454/63 X |
| 5,162,017 | | 11/1992 | Nordin | 454/63 |
| 5,222,906 | | 6/1993 | Lundstöm . | |
| 5,362,273 | | 11/1994 | Pfeiffer, Jr. et al. . | |
| 5,397,266 | | 3/1995 | Nordin . | |
| 5,409,269 | | 4/1995 | Karlsson et al. . | |
| 5,518,447 | * | 5/1996 | Nordin | 454/63 |
| 5,630,751 | * | 5/1997 | Hansen | 454/64 |

* cited by examiner

*Primary Examiner*—Harold Joyce
(74) *Attorney, Agent, or Firm*—Chernoff, Vilhauer, McClung & Stenzel, LLP

(57) ABSTRACT

An exhaust recovery system vents exhaust from an exhaust pipe of a vehicle, located in an enclosed structure, as the vehicle is driven out of the structure. The system includes a coupling attached to a detachably connectable coupling support assembly to support the coupling proximate the vehicle exhaust pipe. An elongate flexible hose has a first end and a second end, where the first end of the hose is connected to the coupling. The second end of the hose is connected to an extendable assembly. A first member is interconnected between the support assembly and the extendable assembly that when tensioned as a result of the vehicle being driven out of the structure extends the extendable assembly. A second member is interconnected between the support assembly and the extendable assembly that when tensioned provides a force sufficient to detach the support assembly from the vehicle, wherein the first member is tensioned prior to tensioning the second member as a result of the vehicle being driven out of the structure.

24 Claims, 4 Drawing Sheets

FIREHOUSE EXHAUST SYSTEM

BACKGROUND OF THE INVENTION

The present invention relates to the collection and discharge of exhaust gases from motor vehicles. More particularly, the present invention relates to an exhaust recovery system for a building which delivers exhaust gases from motor vehicles operating therein to a discharge point outside of the building.

Exhaust gases from a vehicle operating within a closed environment, such as a building, needs to be removed in order to minimize injury to occupants from exposure to the exhaust gases, and particularly to occupants that work, live, or spend considerable time within the closed environment. In particular, removal of exhaust gases is critical for a fire station because the exhaust gases from operating vehicles, such as fire trucks, would be prevalent where the firemen work and sleep if not vented.

When responding to an emergency, the fire truck engine is started and exhaust gases are discharged into the fire station. Exhaust gases continue to be discharged into the fire station until the fire truck has driven out of the fire station. To reduce the discharge of exhaust gases into the fire station, an exhaust hose that is vented to the outside of the fire station could be manually connected to the fire truck's exhaust pipe prior to starting the fire truck. After the fire truck has exited the fire station, the exhaust hose may then be manually disconnected so that the fire truck may continue to the emergency. However, because of the inherent urgency of responding to emergencies it is undesirable to stop the fire truck after leaving the fire station to disconnect the exhaust hose from the fire truck's exhaust pipe. Further, when parking the fire truck within the fire station, the fire truck discharges exhaust gases into the fire station. Likewise, the exhaust hose should be connected to the exhaust pipe prior to parking the fire truck in the fire station.

Melville, et al., U.S. Pat. No. 4,762,054 disclose a vented exhaust extraction rail assembly that includes a stationary top rail with an exhaust spout that slides along the rail. A flexible hose is interconnected between the exhaust spout and the exhaust pipe of a vehicle. Exhaust gases from the vehicle are vented through the flexible hose and rail assembly to the exterior of the building. The exhaust system is oriented in a direction suitable to compensate for variable alignment of parallel parked vehicles. The exhaust system does not permit a vehicle to travel a significant distance in a transverse direction to the rail (toward the door) before the flexible hose is fully extended and thereby detaching the hose from the exhaust pipe. The inability of the vehicle to travel a significant distance prior to disconnection of the hose from the exhaust pipe may result in exhaust discharging into the building. Further, Melville suspends the flexible hose from the top rail at spaced-apart locations which results in looped portions of suspended hose which impedes the movement of workers within the building. In other words, the hose's suspended looped portion creates a work hazard to workers in the vicinity.

Nordin, U.S. Pat. No. 5,162,017, discloses an extendable hose connected to the exhaust pipe of a vehicle in such a way that the exhaust fumes from the vehicle are carried away via the hose. The hose is supported by an overhead runway at spaced-apart locations with trolleys that are moveable along the runway. However, when the hose is not fully extended, portions of the hose droop down between adjacent trolleys obstructing worker's movement in the area. Further, the Nordin system is expensive, in part because of the length of hose required, and the suspended flexible hose tends to wear out after repeated use.

Roberts-Gordon, Inc. of Buffalo, N.Y. markets an exhaust system, sold under the trademark TYKRON, that includes an exterior vent connected to an elevated stationary ball joint. A flexible hose is interconnected between the exhaust pipe of a vehicle, such as a fire truck, and the ball joint. To permit the vehicle to drive out of the building prior to the hose disconnecting from the vehicle, a series of spaced-apart saddles support the hose from an upper rail assembly. The upper rail assembly is aligned in the direction of vehicle travel as it enters and exits the building. As the vehicle drives out of the building, tension is exerted by the exhaust pipe on the hose to pull the trolleys along the upper rail, thereby extending the hose. When the hose is taut, the tension exerted automatically disconnects the hose from the exhaust pipe. Prior to extension, the loops of unextended hose hanging down obstruct workers movement creating a safety hazard. Additionally, the long length of hose with its spring-like character, generates a significant recoil of the hose into the building after detaching from the vehicle. The recoil results in damage to objects and injury to people in the vicinity. Furthermore, the ball joint, long hose, and railing system are expensive.

Hansen, U.S. Pat. No. 5,630,751, incorporated by reference herein, discloses an exhaust recovery system to vent exhaust from an exhaust pipe of a vehicle within a building. A coupling is detachably connectable to the exhaust pipe of the vehicle. An elongate flexible hose is connected between the coupling and a telescoping assembly. The telescoping assembly includes a plurality of tubular members slidably engaged with one another. As the vehicle is moved away from the telescoping assembly it causes the tubular members to slide with respect to one another permitting the vehicle to exit the building which exhaust from the vehicle passes through the hose and the telescoping assembly. The connection between the exhaust pipe and the TYKRON SPRING BOOT coupling sold by Roberts-Gordon, Inc. includes an interior spring therein which is fixedly secured to the exhaust pipe. Unfortunately, the flexible hose tends to significantly stretch before detaching which results in significant recoil of the flexible hose and coupling attached thereto, which could result in damage to objects and injury to people in the vicinity. Further, the coupling has a tendency to periodically "stick" prior to detaching resulting in an even more violent recoil.

What is desired, therefore, is an exhaust recovery system that minimizes the recoil of the flexible hose while simultaneously venting a significant percentage of the vehicle's exhaust.

SUMMARY OF THE INVENTION

The present invention overcomes the aforementioned drawbacks of the prior art by providing an exhaust recovery system to vent exhaust from an exhaust pipe of a vehicle, located in an enclosed structure, as the vehicle is driven out of the structure. The system includes a coupling attached to a detachably connectable coupling support assembly to support the coupling proximate the vehicle exhaust pipe. An elongate flexible hose has a first end and a second end, where the first end of the hose is connected to the coupling. The second end of the hose is connected to an extendable assembly. A first member is interconnected between the support assembly and the extendable assembly that when tensioned as a result of the vehicle being driven out of the structure extends the extendable assembly. A second member is interconnected between the support assembly and the extendable assembly that when tensioned provides a force sufficient to detach the support assembly from the vehicle, wherein the first member is tensioned prior to tensioning the second member as a result of the vehicle being driven out of the structure.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
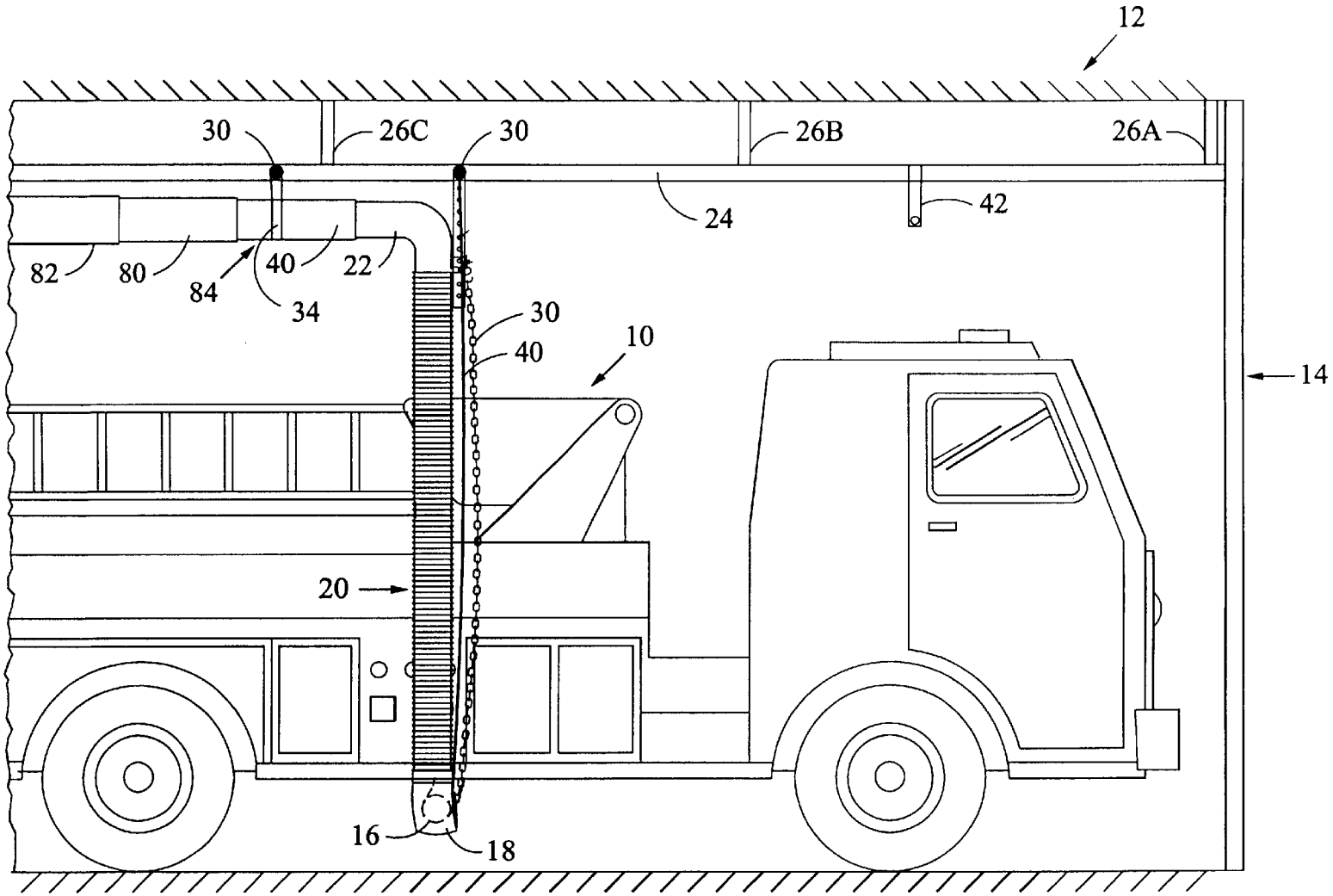
FIG. 1 is a partial sectional side view of a fire truck connected to a retracted exhaust recovery system within a fire station.

Referring to FIG. 1, a vehicle 10 is parked in a building 12, such as a fire truck within a fire station. The building 12 includes a front door 14 that is opened to permit the vehicle 10 to be driven into and out of the building 12. Rescue workers take significant risks when they respond to emergencies. However, their health should not be at risk when working and living within the fire station. Within seconds, exposure to diesel or gasoline engine exhaust gases from vehicles operating within the building 12 may cause headaches and enough discomfort to hinder performance and reaction time. Prolonged exposure to trapped fumes can cause serious respiratory and other health problems.

To reduce the discharge of exhaust gases within the building 12 an exhaust recovery system is employed. A coupling 18 is supported in a position proximate to the exhaust pipe 16. The coupling 18 is attached to and supported by a magnet assembly 17, including a magnet, that disengages from the exhaust pipe 16 when the vehicle 10 leaves the building 12. The coupling 18 is preferably not retained on nor supported by the exhaust pipe 16. In contrast, the magnet assembly 17 is attached to, or otherwise connected to, the coupling 18 to maintain and otherwise support the coupling 18 in a position proximate the exhaust pipe 16. The interconnection of the coupling 18 and the magnet assembly 17 may be by direct connection or an interconnecting member 19, such as for example, a rigid metal member. The magnet assembly 17 and the coupling 18 may be positioned relative to one another at any angular relationship. Preferably the coupling 18 has a larger opening therein than the exterior size of the exhaust pipe 16 and is supported in a position directly in front of the end of the exhaust pipe 16. In addition, the coupling 18 may be partially "overlapping" the exhaust pipe 16 or at a spaced apart location therefrom (e.g., a gap between the end of the exhaust pipe 16 and adjacent the end of the coupling 18). One end of a flexible hose 20, that extends under tension and retracts to its original length when not under tension, is connected to the coupling 18. The flexible hose 20 may include non-flexible portions, if desired. It is noted that the coupling 18 may be merely the end portion of the hose 20. The hose 20 is preferably constructed of a two layer material, including an abrasion resistant outer layer and silicon based inner layer for heat resistance, and further including an internal spiral wire. The other end of the hose 20 is connected to a telescoping assembly 84. The telescoping assembly is aligned with the vehicle 10 and includes multiple tubular members 22, 40, 80, and 82. The telescoping assembly 84 is vented to the exterior of the building (not shown). The telescoping assembly may be any suitable extendable structure for supporting the flexible hose 20, coupling 18, and magnet assembly 17, including looped hose structures discussed previously.

Figure 2A:
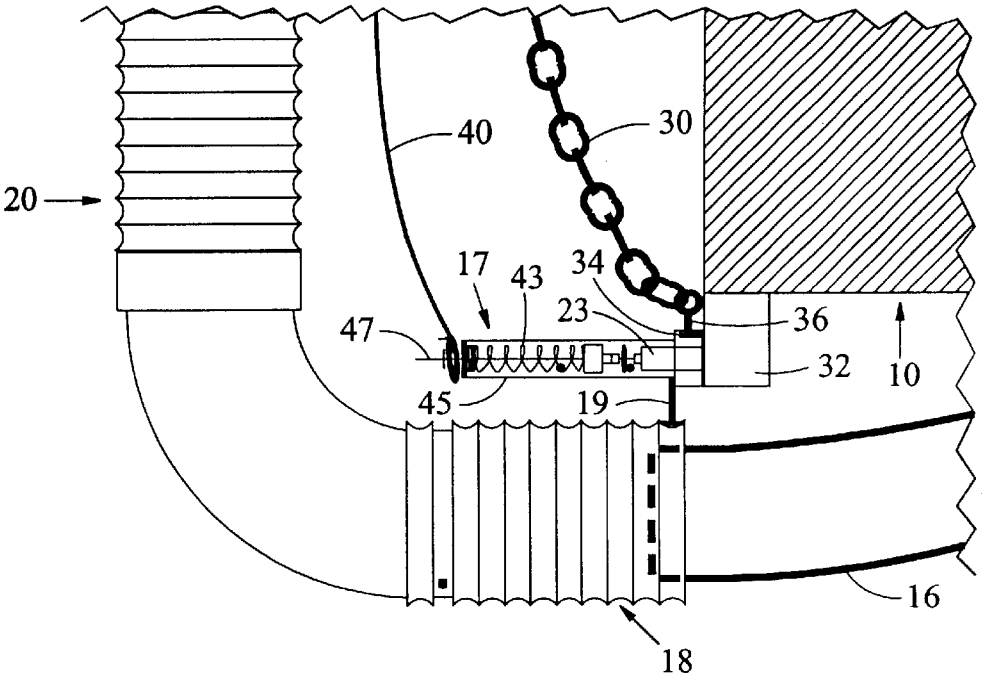
FIG. 2A is a sectional view of the interconnection of the exhaust recovery system, including a coupling and a magnet assembly, to the exhaust pipe of the fire truck of FIG. 1.
Figure 2B:
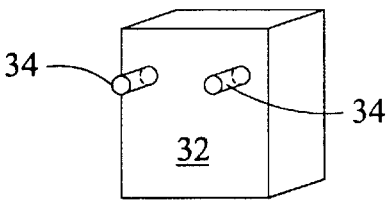
FIG. 2B is a mounting plate shown in FIG. 2A.
Figure 4:
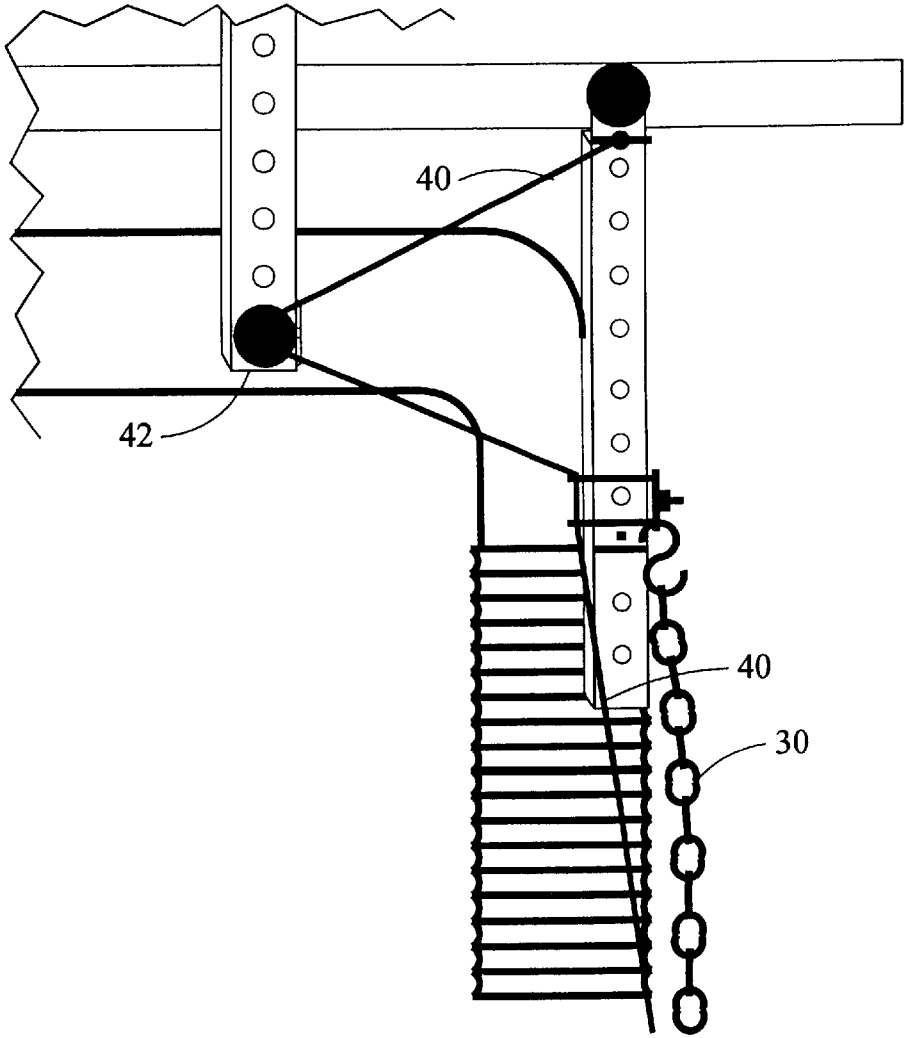
FIG. 4 is a sectional view of the extension and the wire being shortened as the fire truck exits the building.

Referring also to FIGS. 2A and 2B, the magnet assembly 17 is detachably connected to the vehicle 10, preferably using a mounting plate 32, at a location proximate the exhaust pipe 16. The mounting plate 32 provides a predefined location for connection to the vehicle 10, while simultaneously avoiding marring the surface of the vehicle 10. As the vehicle 10 exits the building 12 a chain 30, or other substantially non-stretchable member (including cloth if desired), interconnected between the telescoping assembly 84 and the magnet assembly 17 extends the telescoping assembly 84. If desired, the magnet assembly 17 may provide sufficient resistance from being detached from the mounting plate 32 (or vehicle 10) as the vehicle 10 exits the building 12. The magnet assembly 17 may include an electromagnet with wires connected thereto to provide electrical power. However, electrical power and accordingly the wires associated therewith pose a substantial safety hazard to people in the vicinity. In addition, expensive flexible hose 20 that includes an interior electrical wire therein may also be necessary to route the wire and provide the electrical power. Preferably, the magnet assembly 17 includes a rare earth magnet 23 to provide the interconnection to the vehicle 10 for extending the telescoping assembly 84. Thus, a rare earth magnet 23 avoids the necessity of additional routing additional wires and the expense associated therewith.

Preferably, the mounting plate 32 includes a pair of extensions 34 (e.g., protrusions from the surface thereof) extending out from the surface of the mounting plate 32 that assist in maintaining the magnet assembly 17 attached to the mounting plate 32 as the chain 30 pulls thereon. Alternatively, one extension may be used, if desired, of any shape or structure. In addition, preferably the interconnection 36 between the chain 30 and the magnet assembly 17 is located such that the interconnection 36 is between the ends of the extensions 34 and the plate 32 when the magnet assembly 17 is supported thereon. In this manner, the chain 30 will primarily directly pull on the extensions 34 thus reducing the requirements for a strong magnet to maintain the magnet assembly 17 connected to the plate 32. In addition, it is acceptable though not preferred, to use a ring of extensions or a depression within the plate 32 to retain the magnet assembly 17 because this structure would have a greater likelihood of interfering with the release of the magnet assembly 17 from the mounting plate 32.

Figure 3:
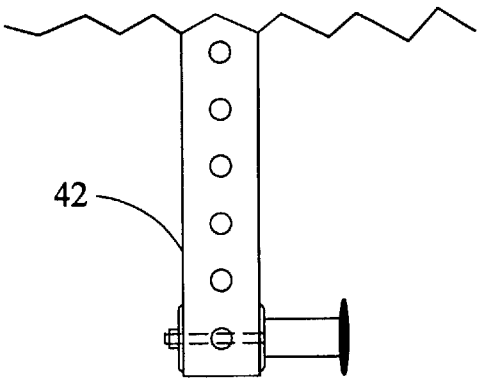
FIG. 3 is a sectional view of an extension for "shortening" the wire attached to the magnet assembly as the fire truck exits the building.

As the telescoping assembly 84 is extended a wire 40, or other flexible and/or bendable member (including cloth if desired), interconnected between the magnet assembly 17 and the telescoping assembly 84 comes into contact with an extension 42, as more clearly shown in FIG. 3. The extension 42 is preferably positioned in a stationary position relative to the telescoping assembly 84. As the telescoping assembly 84 moves relative to the extension 42 the wire 40 is effectively shortened by forming an increasingly greater looped portion. When the telescoping assembly 84 has extended sufficiently relative to the extension 42, the wire 40 will become taught and exert a significant force on the end portion of the magnet assembly 17. The force exerted by the wire 40 will provide a sufficient torque to the magnet assembly 17 to cause it to detach from the plate 32 (vehicle 10). The torque required to detach the magnet assembly 17 from the mountain plate 32 (vehicle 10) is not great, therefore the recoil of the hose 20 will be minimized.

The magnet assembly 17 is preferably biased with a spring 43 so that when the spring 43 is unstressed the magnet 23 is withdrawn within the housing 45. In this manner, when the magnet assembly 17 is not attached to a vehicle 10 the magnet will be unlikely to inadvertently attract other metallic objects. To attach the magnet assembly 17 to the plate 32, the spring 43 is tensioned by pressing the plunger 47 inwardly thereby attaching the magnet 23 to the plate 32. In this manner, when a force is applied by the wire 40, as it is being effectively "shortened", the magnet 23 will have a greater tendency to become detached from the plate 32.

The hose's 20 length is preferably selected such that no suspended loops of hose 20 exist between the tubular member 22 and the exhaust pipe 16. There is no need for the suspended loops of hose 20 because the telescoping assembly 84 provides an extension mechanism, other than the hose itself, to permit the vehicle to exit the building 12 prior to the disconnection of the hose 20 from the exhaust pipe 16. The elimination of the suspended loops of hose 20 reduces the hose's 20 length resulting in a reduction in the recoil of the hose 20 when it becomes detached under tension from the exhaust pipe 16 after the vehicle 10 exits the building 12. The reduction in the recoil of the hose 20 reduces the likelihood of injury to workers and damage to vehicles in the vicinity. Furthermore, the elimination of suspended portions of hose 20 reduces a significant safety hazard to workers in the area.

Figure 5A:
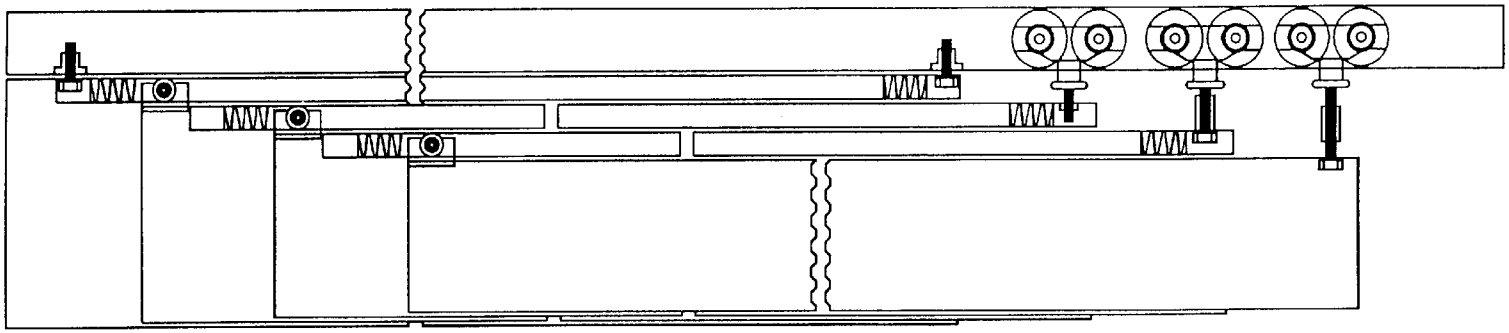
FIG. 5A is a side view of a telescopy assembly.
Figure 5B:
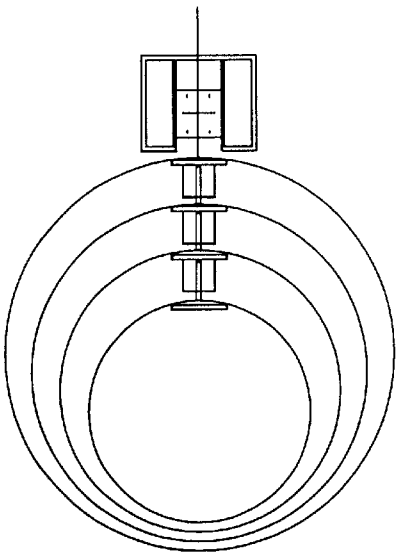
FIG. 5B is an end view of the telescopy assembly of FIG. 5A.

A rail 24 is supported by supports 26*a*, 26*b*, and 26*c* from the building's ceiling or other suitable support. The rail 24 is preferably tubular with a downwardly facing centrally disposed slot running longitudinally along its length to provide a convenient location to locate trolleys 30 therein. Each trolley 30 includes a pair of wheels mounted on a vertical support 34. A circular bracket 36 shaped to tightly surround the exterior of the respective tubular member 22, 40, 80, and 82 is bolted with a bolt to each support 34. The plurality of tubular members 22, 40, 80, 82 are slidably engageable with one another in an aligned relationship supported by a rail 24, as shown in FIGS. 5A and 5B.

Conversely, prior to parking the vehicle 10 within the building 12 the coupling 18 is attached to the exhaust pipe 16 and then the vehicle is driven into the building 12. The telescoping assembly 84 does not exert tension on the hose when fully extended, which occurs in the prior systems with a long suspended hose, so attaching the coupling 18 to the exhaust pipe 16 is performed under little, if any, tension which is more convenient.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An exhaust recovery system to vent exhaust from an exhaust pipe of a vehicle, located in an enclosed structure, as the vehicle is driven out of the structure, comprising:

(a) a coupling attached to a detachably connectable coupling support assembly to support said coupling proximate the vehicle exhaust pipe;

(b) an elongate flexible hose having a first end and a second end, said first end of said hose connected to said coupling;

(c) an extendable assembly;

(d) said second end of said hose connected to said extendable assembly;

(e) a first member interconnected between said support assembly and said extendable assembly that when tensioned as a result of said vehicle being driven out of said structure extends said extendable assembly, while maintaining said elongate flexible hose from being said sufficiently tensioned as a result of said vehicle being driven out of said structure so as to detach from said vehicle; and (f) a second member interconnected between said support assembly and said extendable assembly that when tensioned provides a force sufficient to detach said support assembly from said vehicle, wherein said first member is tensioned prior to tensioning said second member as a result of said vehicle being driven out of said structure.

2. The recovery system of claim 1 wherein said coupling is the end portion of said elongate flexible hose.

3. The recovery system of claim 1 wherein said coupling has an interior diameter greater than the exterior diameter of said exhaust pipe.

4. The recovery system of claim 1 wherein said coupling is substantially in line with said exhaust pipe.

5. The recovery system of claim 1 wherein said coupling support includes a magnet that is detachably engageable to said vehicle.

6. The recovery system of claim 5 wherein said magnet is a rare earth magnet.

7. The recovery system of claim 5 wherein said magnet is an electromagnet.

8. The recovery system of claim 5 wherein said magnet is movable within a coupling support housing of said coupling support.

9. The recovery system of claim 8 wherein said movement of said magnet within said coupling support housing is as a result of a spring.

10. The recovery system of claim 9 wherein said spring biases an exterior surface of said magnet when non-tensioned to a position within said coupling support housing.

11. The recovery system of claim 10 wherein said spring biases said exterior surface of said magnet when tensioned to a position substantially equal to the end of said coupling support housing when attached to said vehicle.

12. The recovery system of claim 5 wherein said magnet is attached to a plate secured to said vehicle that is not otherwise attached to said vehicle when said vehicle is not to be used with said recovery system.

13. The recovery system of claim 12 wherein said plate includes at least one extension therefrom against which said coupling support assembly exerts a force thereon when said coupling support assembly is connected to said vehicle and said vehicle is being said driven out of said structure.

14. The recovery system of claim 13 wherein said at least one extension includes two extensions.

15. The recovery system of claim 12 wherein said first member is attached to said coupling support assembly at a location that is between the exterior end of said at least one extension and said plate when said coupling support assembly is attached to said plate.

16. The recovery system of claim 15 wherein said first member is substantially non-extendable.

17. The recovery system of claim 16 wherein said first member is a chain.

18. The recovery system of claim 1 wherein said first member is said tensioned as a result of said vehicle being driven out of said structure while said second member remains in an un-tensioned state.

19. The recovery system of claim 18 wherein said second member is flexible.

20. The recovery system of claim 19 wherein said second member is tensioned as a result of extending said extendable assembly.

21. An exhaust recovery system to vent exhaust from an exhaust pipe of a vehicle, located in an enclosed structure, as the vehicle is driven out of the structure, comprising:

(a) a coupling attached to a detachably connectable coupling support assembly to support said coupling proximate the vehicle exhaust pipe;

(b) an elongate flexible hose having a first end and a second end, said first end of said hose connected to said coupling;

(c) an extendable assembly;

(d) said second end of said hose connected to said extendable assembly;

(e) a first member interconnected between said support assembly and said extendable assembly that when tensioned as a result of said vehicle being driven out of said structure extends said extendable assembly;

(f) a second member interconnected between said support assembly and said extendable assembly that when tensioned provides a force sufficient to detach said support assembly from said vehicle, wherein said first member is tensioned prior to tensioning said second member as a result of said vehicle being driven out of said structure;

(g) wherein said coupling support includes a magnet that is detachably engageable to said vehicle;

(h) wherein said magnet is movable within a coupling support housing of said coupling support; and (i) wherein said movement of said magnet within said coupling support housing is as a result of a spring.

22. The recovery system of claim 21 wherein said spring biases an exterior surface of said magnet when non-tensioned to a position within said coupling support housing.

23. The recovery system of claim 22 wherein said spring biases said exterior surface of said magnet when tensioned to a position substantially equal to the end of said coupling support housing when attached to said vehicle.

24. An exhaust recovery system to vent exhaust from an exhaust pipe of a vehicle, located in an enclosed structure, as the vehicle is driven out of the structure, comprising:

(a) a coupling attached to a detachably connectable coupling support assembly to support said coupling proximate the vehicle exhaust pipe;

(b) an elongate flexible hose having a first end and a second end, said first end of said hose connected to said coupling;

(c) an extendable assembly;

(d) said second end of said hose connected to said extendable assembly;

(e) a first member interconnected between said support assembly and said extendable assembly that when tensioned as a result of said vehicle being driven out of said structure extends said extendable assembly;

(f) a second member interconnected between said support assembly and said extendable assembly that when tensioned provides a force sufficient to detach said support assembly from said vehicle, wherein said first member is tensioned prior to tensioning said second member as a result of said vehicle being driven out of said structure;

(g) wherein said coupling support includes a magnet that is detachably engageable to said vehicle;

(h) wherein said magnet is attached to a plate secured to said vehicle that is not otherwise attached to said vehicle when said vehicle is not to be used with said recovery system;

(i) wherein said first member is attached to said coupling support assembly at a location that is between the exterior end of said at least one extension and said plate when said coupling support assembly is attached to said plate;

(j) wherein said first member is substantially non-extendable; and (k) wherein said first member is a chain.

* * * * *